US005970561A

United States Patent [19]

Archibeque

[11] Patent Number: 5,970,561

[45] Date of Patent: Oct. 26, 1999

[54] GOLF BAG WITH SHOE CLEANING DEVICE

[76] Inventor: John S. Archibeque, 4450 Lidia Ct., Chino, Calif. 91710

[21] Appl. No.: 09/095,577

[22] Filed: Jun. 11, 1998

[51] Int. Cl.[6] ..... A47L 23/00; A47L 23/22

[52] U.S. Cl. ..... 15/161; 15/184; 206/315.3

[58] Field of Search ..... 15/112, 160, 161, 15/215–217, 237–241, 184; 206/315.3, 315.2

[56] References Cited

U.S. PATENT DOCUMENTS

| | | | |
|---|---|---|---|
| 1,479,644 | 1/1924 | Browne | 280/169 |
| 1,670,867 | 5/1928 | Paskal | 15/112 |
| 1,870,333 | 8/1932 | Kadavy | 15/237 |
| 1,946,578 | 2/1934 | Glauber et al. | 15/237 |
| 2,962,744 | 12/1960 | Hodgin | 15/161 |
| 3,028,617 | 4/1962 | Racina | 15/160 |
| 3,142,853 | 8/1964 | Hensley | 15/160 |
| 4,733,424 | 3/1988 | Gurkin | 15/161 |
| 5,437,075 | 8/1995 | Peake | 15/161 |
| 5,479,674 | 1/1996 | Gilcrest | 15/161 |

FOREIGN PATENT DOCUMENTS

| | | | |
|---|---|---|---|
| 19 01 836 | 8/1970 | Germany | 15/161 |
| 2232580 | 12/1990 | United Kingdom . | |

*Primary Examiner*—Mark Spisich
*Attorney, Agent, or Firm*—Richard C. Litman

[57] ABSTRACT

An improved golf bag with a built-in golf shoe cleaning device, which includes a base with a storage cavity therein, having a mouth exterior to the bag. A cleaning brush is mounted on a generally rectangular drawer member which is slidably inserted into mouth and fully retractable into the cavity in a closed condition, and, which is slidably extended in an open position. The drawer is biased toward an open position by a spring assembly that is mounted inside the cavity. The drawer is maintained in a closed position by a catch that may be released by the users's foot. When released, the drawer is biased outward automatically to a fully extended open position. An internal stop is attached to the rear of the drawer to prevent the drawer from completely exiting the cavity by engaging the base proximate the mouth.

12 Claims, 4 Drawing Sheets

GOLF BAG WITH SHOE CLEANING DEVICE

BACKGROUND OF THE INVENTION

1. FIELD OF THE INVENTION

The present invention relates to golfing equipment, and in particular to a golf bag having a built-in shoe cleaning device.

2. DESCRIPTION OF THE RELATED ART

The game of golf requires player to address a golf ball in a variety of terrains. The variety of terrains found on a given golf course is one of the great attractions of the game. With the added effects of weather and seasons, which can harden or soften a given surface, the golfer can be faced with a variety of different surface conditions in a single game. Occasionally, surfaces can hamper a game, particularly if the player's shoes lack sufficient traction. While traction is important when traversing a golf course, it can be crucial when addressing the golf ball. Bad traction can ruin a game of golf and even result in injury. The need for traction has long since given rise to a variety of golf shoes aimed at improving traction.

Golf shoes are typically characterized by a number of spikes extending from the soles of the shoes. When the shoes are in use, these spikes occasionally become clogged with turf or mud, resulting in a reduction or loss of traction. Dirty golf shoes can also be quite messy, and can quickly soil a trunk, locker, or car interior.

A variety of devices have been created to clean golf shoes. One such device is a cleaning brush designed to mount on a golf cart. Problems are encountered with such devices because they must, of necessity, project from the cart at a location readily accessible to the golfer and, they must be sufficiently rigid to permit the golfer to scrub dirt from his or her cleats. The rigid mounting and accessible location of such cleaners can cause injury to a player who walks into a shoe cleaning brush, or who is struck by a cleaning brush on a passing golf cart. Similarly, an impact with an object can damage the cart or brush. In order to overcome these problems, removable brushes were attached to the carts. However, these brushes must be stored separately and are prone to being misplaced. Another type of golf shoe cleaning device is one that attaches to a golf bag by a hinge which allows the brush to be folded out of the way. While this construction prevents someone from accidentally walking into the brush, the folded brush may still cause damage to a car interior, or become caught on an object.

Therefore, there is a need for a golf shoe cleaning device which is readily and rigidly supported for convenient use, yet may be stored inside the base of the golf bag, thereby minimizing damage or harm caused by inadvertent impact.

Examples of the inventions as summarized above include the following patent publications. U.S. Pat. No. 2,962,744 discloses a Shoe Brushing Device for use on an automobile. The device attaches under the floor of an automobile body and is moved between extended and concealed positions by an electric motor and fails to suggest its use in combination with a golf bag.

Typical examples of brushes intended for use with golf carts include those described in UK Pat. No. 2,232,580, which discloses a Shoe Cleaning Device For A Golf Cart having shoe cleaning surfaces, for removing heavy or light dirt, attached to the cart and U.S. Pat. No. 3,028,617 which discloses a Golf Shoe Cleat Cleaner comprising a golf shoe cleaning brush which is mounted onto a golf cart. Each brush can be pivoted to an out of the way position when not in use, but is unadaptable for use as described with a golf bag. Likewise, U.S. Pat. No. 3,142,853 discloses a Brush Assembly With Attachment Clamp for connection to a golf cart. The device comprises a wire brush that is removably attached to the cart frame, not intended to be permanently affixed. U.S. Pat. No. 5,437,075 discloses a Self-Storing Shoe Cleaning Brush that also removably mounts onto a golf cart. The brush is attached to the cart by a spring hinge which biases the brush into a non-use position. The brush is retained in an operative position by a removable brace.

Most notably, although U.S. Pat. No. 5,479,674 discloses a Golf Shoe Cleaning Apparatus For Attaching To A Golf Bag, the device comprises a cleaning brush which is removably retained inside a drawer member. The drawer member is pivotally attached to the base of a golf bag by means of a mounting bracket, and may be moved between use and non-use positions. No provision is taught for concealing the brush internal to the golf bag floor without aid of an externally mounted bracket.

None of the above inventions and patents, taken either singularly or in combination, is seen to describe the instant invention as claimed. Thus a golf bag with shoe cleaning device solving the aforementioned problems is desired.

SUMMARY OF THE INVENTION

In view of the foregoing limitations of the golf show cleaning devices described in the prior art, the present invention provides an improved golf bag with a built-in golf shoe cleaning device which is readily and rigidly supported for convenient use, yet may be stored inside the base of the golf bag, thereby minimizing damage or harm caused by inadvertent impact.

The invention comprises a standard golf bag modified to include a base with a storage cavity therein, the base having a mouth in communication between the cavity and the exterior of the bag. A cleaning brush is mounted on a generally rectangular drawer member which is slidably inserted through the mouth, the drawer being fully retractable into the cavity in a closed condition, and, which is slidably extended in an open position. The drawer is biased toward an open position by a spring that is mounted inside the base. The drawer is maintained in a closed position by a catch that may be released by the users's foot. When released, the drawer is biased outward automatically to a fully extended open position. An internal stop flange is attached to the rear of the drawer to prevent the drawer from completely exiting the cavity by engaging the base proximate the mouth.

Accordingly, it is a principal object of the invention to provide a golf bag with a built-in golf shoe cleaner that is easy to use.

It is another object of the invention to provide a golf bag with a built-in golf shoe cleaner that is retractably stored in the base of the golf bag.

It is a further object of the invention to provide a golf bag with a built-in golf shoe cleaner that may be released from the base of the golf bag by a foot-depressed, resilient release mechanism.

Still another object of the invention is to provide a golf bag with a built-in golf shoe cleaner having a cleaning brush that is quickly and easily removed.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
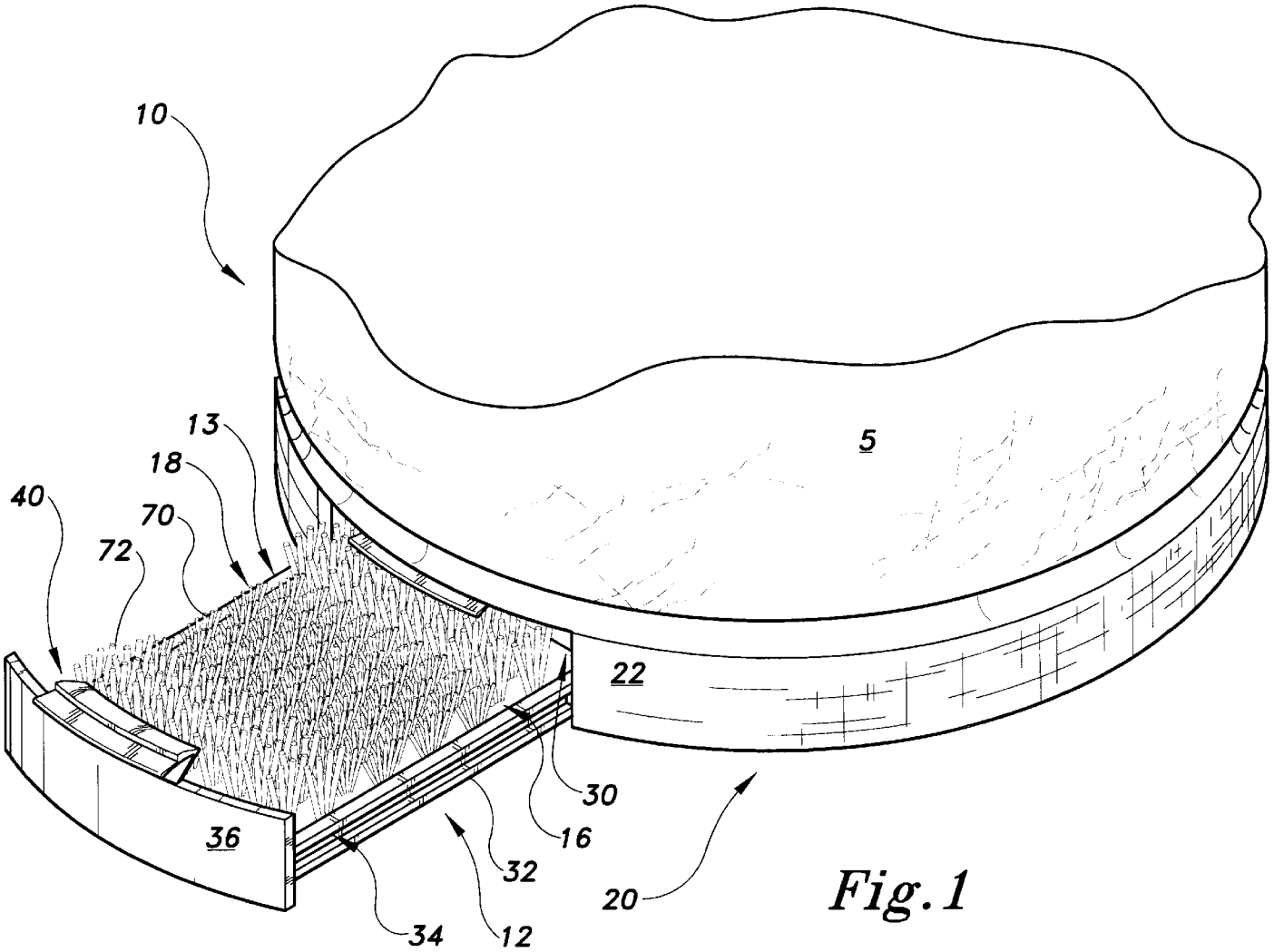
FIG. 1 is a partial, perspective view of a golf bag with the shoe cleaning device of the present invention as incorporated into the base of the bag, the device in the open position.
Figure 5:
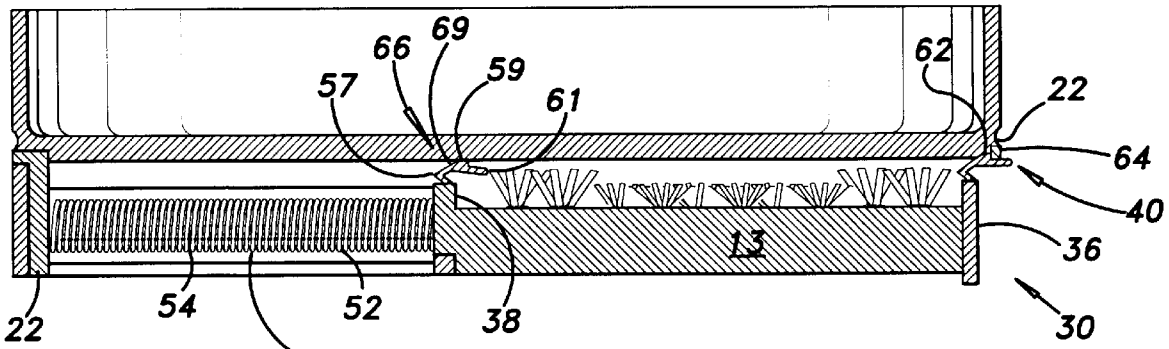
FIG. 5 is a cross section of the base showing drawer in a closed condition.

Referring now generally to the Figures together, a golf shoe cleaner 10 of the present invention is shown as an integral part of a golf bag base 20 which is attached to a golf bag 5 (partially shown). The base 20 includes a drawer 12 which is retractably housed within a cavity 14 (FIG. 2) defined within the base 20. The drawer 12 has an upper surface 16 on which brush 18 is disposed, suitably dimensioned for cleaning the soles of a shoe. Means for extending the drawer 12 to an open position (as shown in FIG. 1) and for maintaining the drawer 12 in a closed position (as shown in FIG. 5) comprise a plurality of interacting components housed by the base 20 largely internally. As shown in the preferred embodiment pictured in the Figures, the components comprise a spring assembly 50 which biases the drawer outwardly, and, a latching mechanism 40 which holds the drawer 12 within the cavity under spring compression, so that, when the latching mechanism 40 is released, the drawer 12 is automatically biased to the open position by means of the spring assembly 50.

Figure 2:
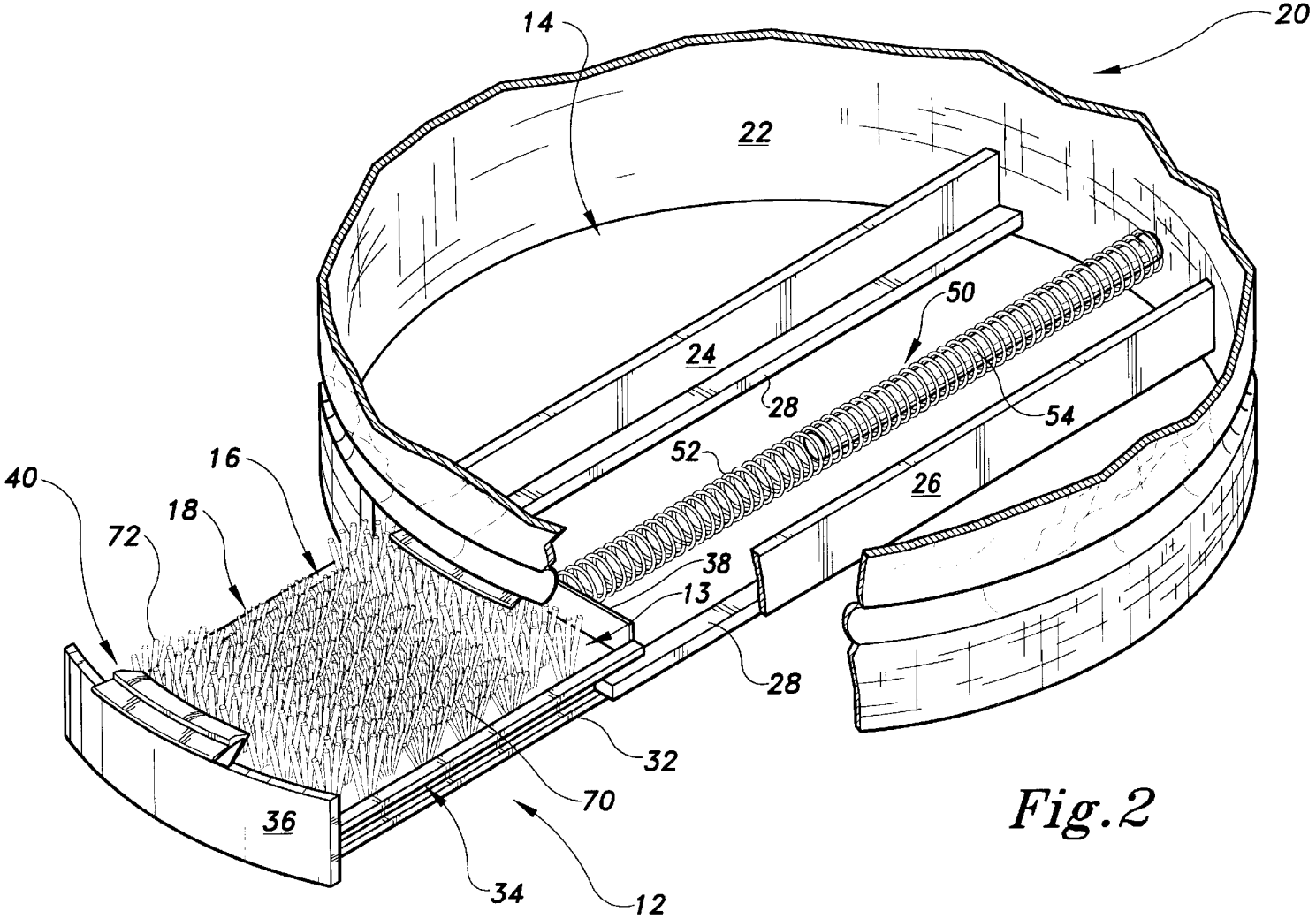
FIG. 2 is a partial, fragmented perspective view of the present invention showing the internal structure of the base.
Figure 3:
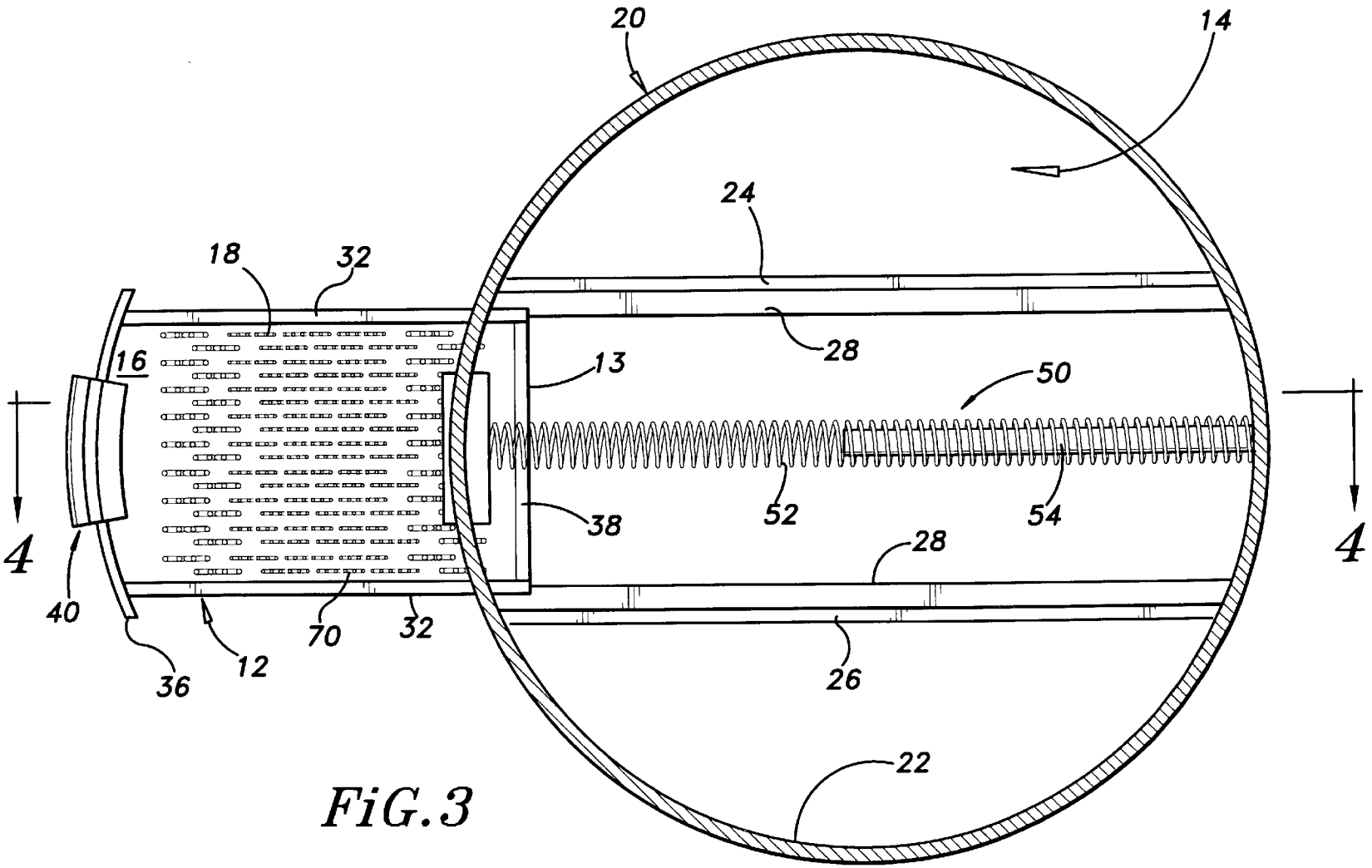
FIG. 3 is a top cross-sectional view of the present invention.

As seen more specifically in FIGS. 2 and 3, the base 20 is defined by a generally circular perimeter wall 22 depending from the bag 5, the base having a ceiling defined by the floor of the bag 5. The perimeter wall 22 defines a generally rectangular opening or mouth 30 and the cavity 14 disposed directly below the golf bag 5. The base may have a floor spanning the perimeter wall 22; however, the base is shown without one in the preferred embodiment. Within the cavity 14, a first wall 24 and a second opposing wall 26 are positioned generally transversely across the cavity 14, attached to the perimeter wall 22 generally perpendicular to the mouth 30, and spaced to define an enclosure for receiving the drawer 12. Both the first wall 24 and the second wall 26 each have a longitudinally extending rail 28, which serves as a track upon which the drawer 12 slidably rides in a reciprocal motion.

The drawer 12 is in turn dimensioned and configured to be received by the track. The drawer 12 is defined by a generally flat and rectangular body 13 which, in addition to the upper surface 16 having brush 18, includes two sides 32, a front face 36 and a rear stop flange 38. The brush 18 preferably comprises bristles 70 integrally tufted into the body 13, and an array of stiff projections 72, such as wires, for cleaning stubborn clods from the shoe sole edges. Each of the sides 32 define a channel 34 for slidably receiving a different one of rails 28, 28. The front face 36 is sized to cover and close the mouth 30 defined by perimeter wall 22. As will be described in greater detail below, the latching mechanism 40 may comprise an resilient hinge and latch unit integrally formed with the face 36.

In an assembled state, the drawer 12 is inserted into mouth 30 and is housed by base 20. In a closed state, the drawer 12 is received fully onto the rails 28 of the track within the cavity 14 wherein the front face 36 forms a closure of mouth 30 generally flush with the exterior surface of the perimeter wall 22. In an open state, the drawer body 13 is extended outward and partially supported by the rails 28. The rear stop flange 38 includes a rear catch 66 (FIGS. 4 & 5), both extending upwardly from the upper surface 16 of the drawer body 13. The catch 66 and flange 38 are positioned and sized to engage the interior of the perimeter wall 22 to prevent the drawer 12 from sliding off of its track as more fully described below. The stop flange 38 also serves as a surface against which the biasing means may act to outwardly bias the drawer 12.

In the preferred embodiment, the biasing means comprises a spring assembly 50 including a coil spring 52 transversely biased between stop flange 38 and an opposing interior surface of the perimeter wall 22. For added lateral stability of the coil spring, a support rod 54 may be internally disposed within the coils, the rod 54 affixed and depending from the opposing surface of the perimeter wall 22, thus permitting the spring 52 to be tightly coiled with minimal lateral movement during compression. However, it should be apparent to one skilled in the art that other biasing means may be used to effect the same purpose as that of the spring assembly 50 used in the preferred embodiment.

Figure 4:
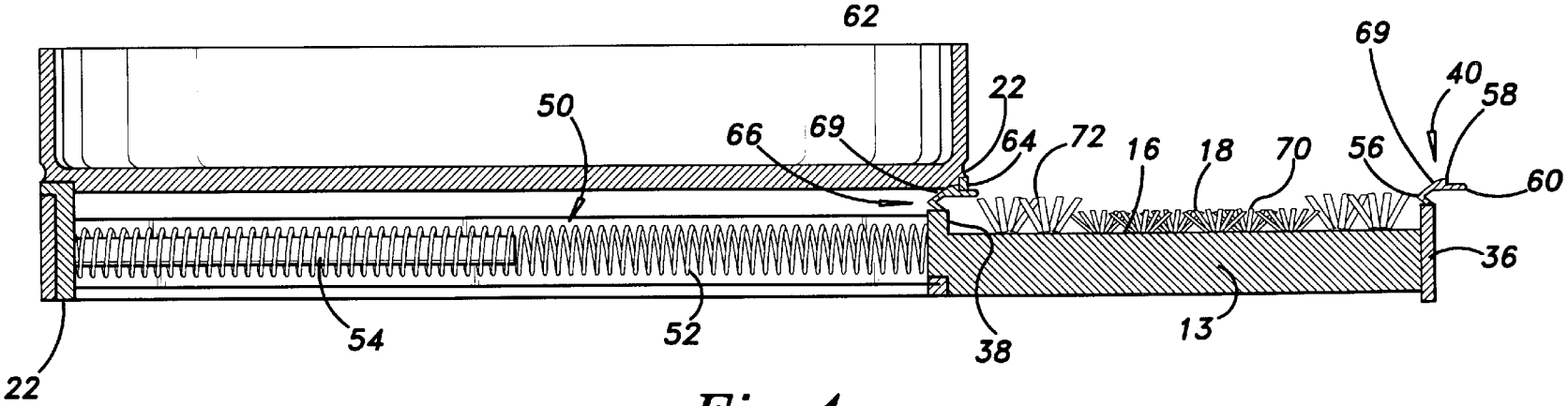
FIG. 4 is a cross section as taken along the line 4—4 of FIG. 3 showing the drawer in an open position.

With the drawer under compression, the latching mechanism 40 is necessary to maintain the drawer 12 in a closed state. As best seen in FIGS. 4 and 5, the latching mechanism 40 comprises a resilient hinge and latch unit integrally formed with the face 36 and acting in cooperation with the perimeter wall 22. The unit comprises a resilient hinge 56, a tooth 58 formed at the apex of the hinge 56, and a release tab 60 depending from the hinge 56 extending outwardly from face 36. The tooth 58 is positioned to enter a recess 62 having a lip 64 depending from the perimeter wall 22 into mouth 30, the lip 64 positioned to impinge upon entry of the tooth 58 enough to cause flexing of the resilient hinge 56 and thereby permit the tooth 58 to pass into the recess 62 behind lip 64. Thus, in a closed position, the latching mechanism 40 of drawer face 36 is engaged to the lip 64 of the perimeter wall 22 preventing outward movement of drawer 12 caused by the bias of spring 52. Therefore, in a closed position, by depressing the release tab 60, the tooth 58 may be disengaged from the recess 62, thereby permitting the biasing force stored in the spring assembly 50 to automatically bring the drawer 12 to an open position. However, it again should be apparent to one skilled in the art that other latching means may be used to effect the same purpose as that of the latching mechanism 40 used in the preferred embodiment.

In addition to the latching mechanism 40, the rear catch 66 is provided depending from the stop flange 38 which, in a like manner, engages recess 62 when the drawer 12 is an open position. The rear catch 66 limits the outward movement of the drawer 12 while a user is brushing the sole of the shoe and prevents the complete expulsion of the drawer 12 from the cavity 14. The rear catch unit comprises a resilient hinge 57, a tooth 59 formed at the apex of the hinge 57, and a release tab 61 depending from the hinge 57 extending outwardly towards face 36. The tooth 59 is sized and positioned to also engage recess 62 having a lip 64 depending from the perimeter wall 22 into the mouth 30. Thus, in an open position, the rear catch 66 is engaged to the perimeter wall 22 preventing outward movement of drawer 12. Therefore, in an open position, by depressing the release tab 61, the tooth 59 may be disengaged from the recess 62, thereby permitting the user to remove the drawer 12 when necessary, for cleaning and the like. However, it again should be apparent to one skilled in the art that other catching means may be used to effect the same purpose as that of the rear catch 66 used in the preferred embodiment.

To rebias the spring assembly 50 in order to store the drawer 12 in a closed position, the drawer is simply pushed in by the user to compress the spring 52 again. Each of tooth 59 and tooth 58 are approached by an inclined surface 69 defined by a portion of each hinge 56, 57, the incline 69 facing inwards toward the cavity 14. Thus, as the drawer 12 is pushed inwards, the incline 69 of the catch 66 permits the hinge 57 to ride out of the mating incline of the recess 62 and simultaneously flex the hinge downward to automatically bring the tooth 59 out of engagement with recess 62. Likewise, as the latching mechanism 40 approaches lip 64, the hinge 56 is forced to flex, the lip 64 riding incline 61 of hinge 56 until the tooth 58 passes lip 64 and snaps back into recess 62 thereby latching the drawer 12 into the closed position.

It is to be understood that the present invention is not limited to the embodiment described above, but encompasses any and all embodiments within the scope of the following claims.

I claim:

1. A golf bag having a built-in shoe cleaning device comprising:

a bag portion;

a base depending from said bag portion and defined by a perimeter wall generally concentric and axially aligned with said bag portion, said wall defining a mouth and a cavity interior to said base;

a drawer having a shoe sole cleaning means, said drawer slidably inserted through said mouth and disposed in said cavity, said drawer selectively disposed in a closed position wherein said shoe sole cleaning means is enclosed within said cavity and said drawer is substantially hidden within said cavity, and an open position wherein substantially all of said shoe sole cleaning means is extended and presented for use exterior to said bag portion and said base.

2. A golf bag having a built-in shoe cleaning device according to claim 1, wherein said cleaning means includes an array of bristles.

3. A golf bag having a built-in shoe cleaning device according to claim 1, wherein said cleaning means includes a plurality of stiff projections.

4. A golf bag having a built-in shoe cleaning device according to claim 1, said base further comprising a drawer biasing means disposed within said cavity for biasing said drawer toward the open position.

5. A golf bag having a built-in shoe cleaning device according to claim 4, said drawer further including a catch for limiting the extension of said drawer in the open position.

6. A golf bag having a built-in shoe cleaning device according to claim 5, wherein said perimeter wall further defines a recess proximate said mouth and positioned to engage said catch, said catch further comprising a resilient hinge, a tooth for engaging said recess, and a release tab for depressing said hinge to release said tooth from said recess when engaged.

7. A golf bag having a built-in shoe cleaning device according to claim 4, wherein said drawer biasing means is a spring assembly including a coil spring biased between said drawer and said perimeter wall.

8. A golf bag having a built-in shoe cleaning device according to claim 7, said base further comprising an elongated support member disposed within said coil spring.

9. A golf bag having a built-in shoe cleaning device according to claim 1, said drawer further including a latching means for retaining said drawer in the closed position.

10. A golf bag having a built-in shoe cleaning device according to claim 9, wherein said perimeter wall further defines a recess proximate said mouth and positioned to engage said latching means, said latching means further comprising a resilient hinge, a tooth for engaging said recess, and a release tab for depressing said hinge.

11. A golf bag having a built-in shoe cleaning device according to claim 10, said drawer further including a catch for limiting the extension of said drawer in the open position, said catch further comprising a resilient hinge, a tooth for engaging said recess, and a release tab for depressing said hinge.

12. A golf bag having a built-in shoe cleaning device according to claim 1, said base further including a pair of walls spaced apart to slidably receive said drawer, each of said pair of walls having a rail, wherein further said drawer defines a pair of sides each defining a channel for receiving one said rail, thereby defining a track receiving said drawer for reciprocal sliding.

* * * * *